US011759039B1

(12) United States Patent
Cintron

(10) Patent No.: US 11,759,039 B1
(45) Date of Patent: Sep. 19, 2023

(54) ADJUSTABLE PORTABLE CUP HOLDER

(71) Applicant: Jacqueline Cintron, Eielson Air Force Base, AK (US)

(72) Inventor: Jacqueline Cintron, Eielson Air Force Base, AK (US)

( * ) Notice: Subject to any disclaimer, the term of this patent is extended or adjusted under 35 U.S.C. 154(b) by 170 days.

(21) Appl. No.: 17/149,036

(22) Filed: Jan. 14, 2021

(51) Int. Cl.
*A47G 23/00* (2006.01)
*A47G 23/02* (2006.01)

(52) U.S. Cl.
CPC ..... *A47G 23/0225* (2013.01); *A47G 23/0241* (2013.01); *A47G 23/0266* (2013.01)

(58) Field of Classification Search
None
See application file for complete search history.

(56) References Cited

U.S. PATENT DOCUMENTS 1,093,873 A * 4/1914 Mitchell ..... B65D 21/086 220/8
1,264,040 A * 4/1918 Fackler ..... B65D 21/086 220/8
2,438,434 A * 3/1948 Friedman ..... B65D 41/26 206/217
3,285,459 A * 11/1966 Gahm ..... A61J 7/0046 206/218
5,384,138 A * 1/1995 Robbins, III ..... B65D 1/40 220/666
5,474,272 A 12/1995 Thompson et al.
5,533,638 A * 7/1996 Robbins, III ..... B65D 43/0212 220/660
D378,334 S 3/1997 Legere
5,720,516 A * 2/1998 Young ..... A47C 7/68 297/188.14
6,412,741 B1 * 7/2002 Olivero ..... A47G 23/0225 248/311.2
6,666,329 B1 12/2003 Charbonneau
8,556,099 B2 * 10/2013 Perlman ..... B65D 11/1873 206/217
8,777,307 B2 7/2014 Nelson et al.
9,016,491 B2 4/2015 Blum et al.
9,109,744 B1 8/2015 Guerrero
9,205,954 B2 12/2015 Huang et al.
9,706,831 B2 7/2017 Wu et al.
9,751,660 B2 * 9/2017 Jasin ..... F41H 3/00
10,045,645 B2 8/2018 Kim
10,336,499 B2 7/2019 Wambolt
10,393,564 B1 * 8/2019 Dabney ..... G01F 19/00
D871,151 S * 12/2019 Hudson ..... D7/532
2006/0220327 A1 * 10/2006 Russell ..... F16J 15/121 277/611

* cited by examiner

*Primary Examiner* — Steven M Marsh
(74) *Attorney, Agent, or Firm* — CRAMER PATENT & DESIGN, PLLC; Aaron R. Cramer

(57) ABSTRACT

The adjustable portable cup holder may comprise a top ring, a bottom ring, a plurality of intermediate rings, and an attachment band. The adjustable portable cup holder may be coupled to a mounting point and may be operable to hold a beverage container. The adjustable portable cup holder may collapse for storage and expand for use. The attachment band may adjust to fit the mounting point. As non-limiting examples, the beverage container may be a beverage cup, a water bottle, or a beverage can. As non-limiting examples, the mounting point may be a beach chair, a stroller, or a grocery cart.

5 Claims, 10 Drawing Sheets

ADJUSTABLE PORTABLE CUP HOLDER

RELATED APPLICATIONS

Not applicable.

FIELD OF THE INVENTION

The present invention relates generally to a cup holder and more specifically to an adjustable and portable cup holder.

BACKGROUND OF THE INVENTION

Whether it be a morning cup of coffee, a glass of water or a fitness drink during exercise, staying properly hydrated is an important and daily task. In fact, most people seldom leave their house without carrying a cup of coffee, thermos, or water bottle.

This being the case, many automobiles, strollers, and exercise equipment devices are manufactured having a pre-existing cup holder. These cup holders are often handy and generally work well. However, a shared public cup holder may not always be as clean as one would prefer. Additionally, given the current pandemic, having a clean cup holder is more important than ever. Therefore, the need exists for a cup holder that is portable, individualized, and cleanable. The adjustable portable cup holder fulfills this need in a manner that is safe and cost effective.

SUMMARY OF THE INVENTION

The inventor has recognized the aforementioned, inherent problems and lack in the art and observed that there is a need for an adjustable portable cup holder which has a top ring which in turn has a top, a bottom, and a top aperture. The top aperture is vertically oriented within the top ring and the top aperture includes a top and a bottom. The adjustable portable cup holder also has bottom ring which has a bottom surface, a plurality of intermediate rings which have a plurality of annular bands that are interposed between the top ring and the bottom ring, and an attachment band adjusted to fit a mounting point of a beverage container. The attachment band is coupled to the top ring and the attachment band includes an adjustment gap which is operable to adjust an inside diameter of the attachment band.

The top aperture may include a plurality of sloped internal walls. The top of the top aperture may be wider than the bottom of the top aperture. The bottom of the top aperture may be at least as large as an outside diameter of the beverage container such that the beverage container passes through the top ring when inserted into the top ring from the top of the top ring. The top ring may become immovable when the attachment band is coupled to the mounting point. The collapsing and expanding of the adjustable portable cup holder may be achieved by pushing and pulling the bottom ring.

The bottom ring may include the bottom surface which may prevent the beverage container from passing through the bottom ring. The intermediate ring may have a plurality of decreasing diameters with a highest intermediate ring being larger than a lowest intermediate ring. The intermediate ring may be vertically tapered. The intermediate rings may slidably couple to each other and collapse to a height of one of the individual intermediate rings when each of the individual intermediate rings slide up into the ring immediately above it. The attachment band may include a release clip. The adjustable portable cup holder may be coupled to the mounting point by operating the release clip to open the attachment band, passing the attachment band around an armature of the mounting point. The release clip may close the attachment band. The beverage container may be inserted into the top aperture of the top ring and the beverage container's weight pushes the bottom ring down.

The bottom ring pulls the intermediate rings causing the adjustable portable cup holder to expand until the adjustable portable cup holder supports the beverage container. The beverage container may be removed from the adjustable portable cup holder when the bottom ring is pushed towards the top ring to collapse the adjustable portable cup holder and the attachment band is decoupled from the mounting point. The mounting point may be selected from the group consisting of a beach chair, a stroller, or a grocery cart. The beverage container may be selected from the group consisting of a beverage cup, a water bottle, or a beverage can. The adjustable portable cup holder may be coupled to the mounting point and is operable to hold the beverage container. The adjustable portable cup holder may collapse for ease of storage and expands when ready for use.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
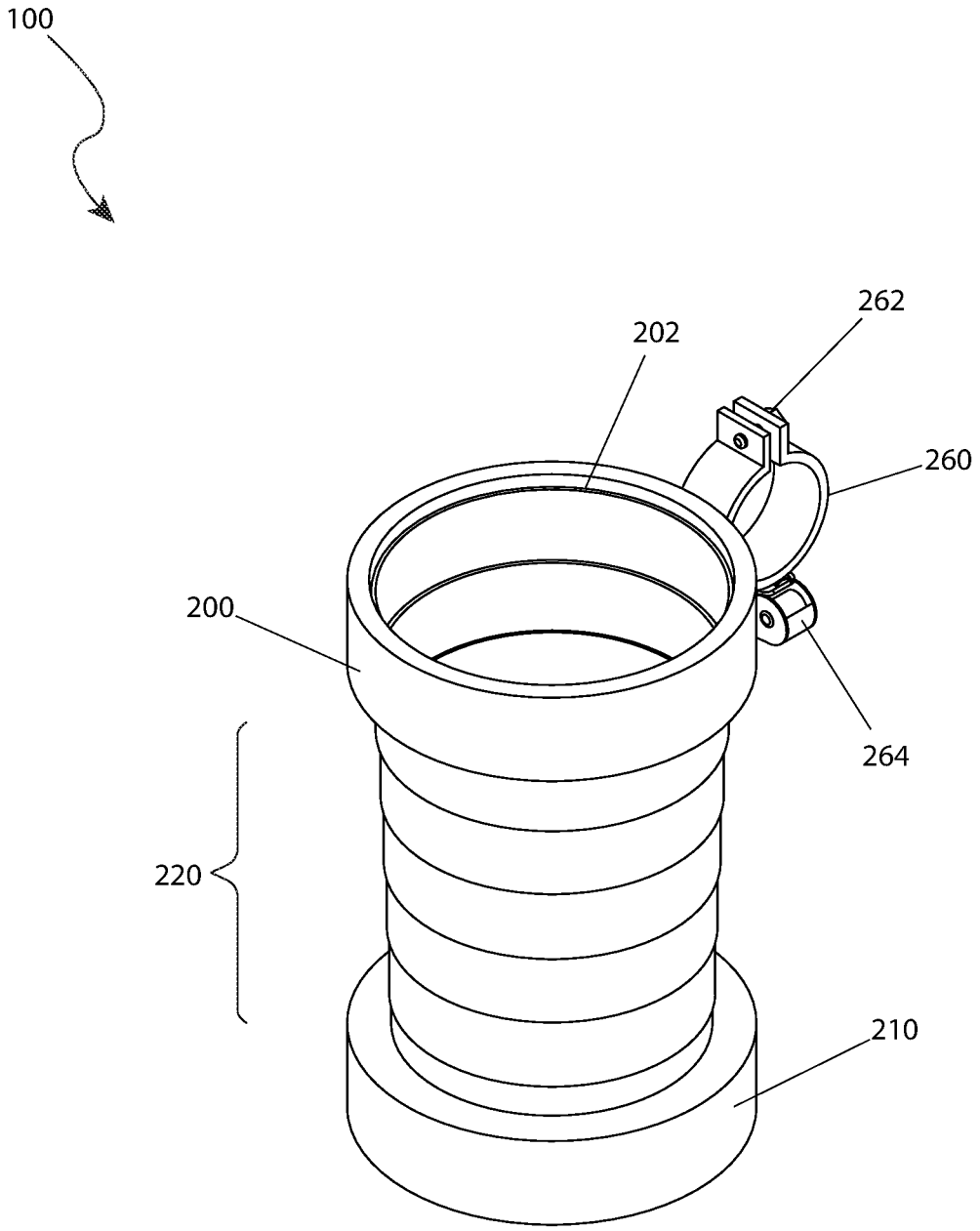
FIG. 1 is an isometric view of an adjustable portable cup holder, according to an embodiment of the present invention.

100 adjustable portable cup holder
200 top ring

202 top aperture
210 bottom ring
212 bottom surface
220 plurality of intermediate rings
230 individual intermediate ring
240 ring immediately above
242 ring immediately below
250 highest intermediate ring
252 lowest intermediate ring
260 attachment band
262 adjustment gap
264 release clip
270 first diameter
272 second diameter
274 third diameter
276 fourth diameter
278 fifth diameter
280 sixth diameter
282 seventh diameter
900 beverage container
910 mounting point

DESCRIPTION OF THE INVENTION

Figure 8:
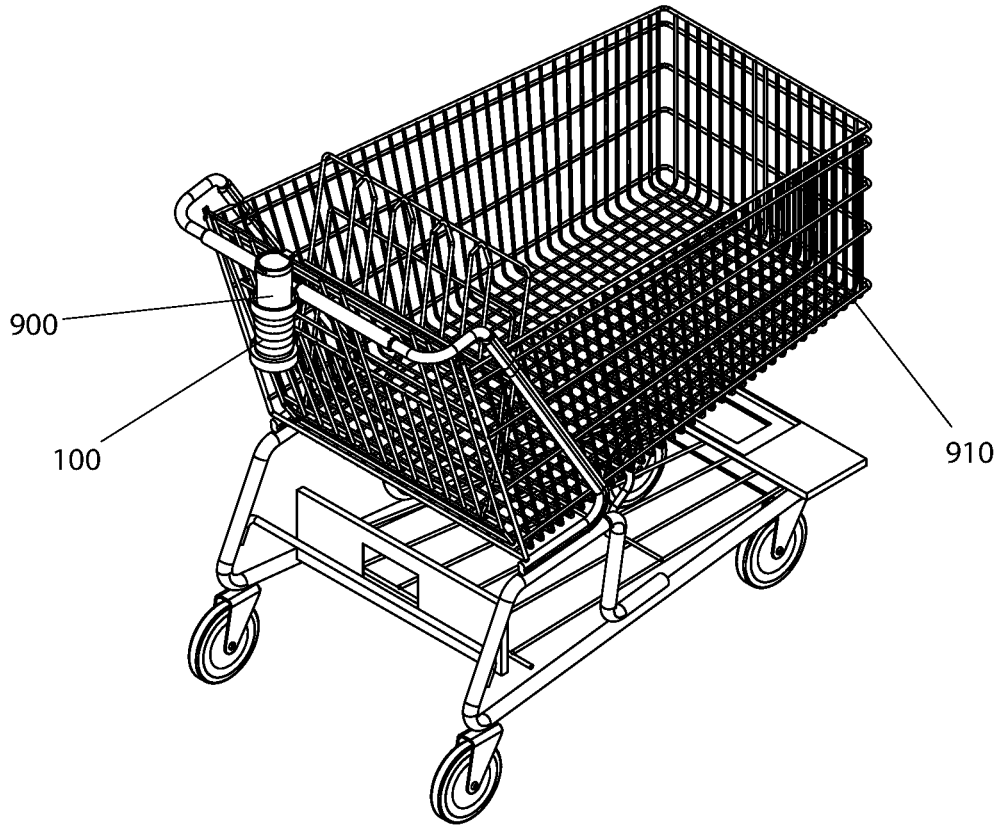
FIG. 8 is an in-use view of an adjustable portable cup holder, according to an embodiment of the present invention illustrating the adjustable portable cup holder coupled to a mounting point (the handle of a grocery cart).

The present invention is directed to an adjustable portable cup holder (herein described as the "invention") 100. The invention 100 may comprise a top ring 200, a bottom ring 210, a plurality of intermediate rings 220, and an attachment band 260. FIG. 8 is an in-use view of an adjustable portable cup holder, according to an embodiment of the present invention illustrating the adjustable portable cup holder coupled to a mounting point (the handle of a grocery cart). The invention 100 may be coupled to a mounting point 910 and may be operable to hold a beverage container 900. The invention 100 may collapse for storage and expand for use. The attachment band 260 may adjust to fit the mounting point 910. As non-limiting examples, the beverage container 900 may be a beverage cup, a water bottle, or a beverage can. As non-limiting examples, the mounting point 910 may be a beach chair, a stroller, or a grocery cart. FIG. 8 shows the invention 100 coupled to the grocery cart.

The top ring 200 may be an annular collar surrounding the top of the invention 100. The top ring 200 may comprise a top aperture 202 that is vertically oriented within the top ring 200. The top aperture 202 may comprise sloped internal walls such that the top of the top aperture 202 is wider than the bottom of the top aperture 202. A first diameter 270 measured as the inside diameter at the bottom of the top aperture 202 may be at least as large as the outside diameter of the beverage container 900 such that the beverage container 900 may pass through the top ring 200 when inserted into the top ring 200 from the top of the top ring 200.

Figure 6:
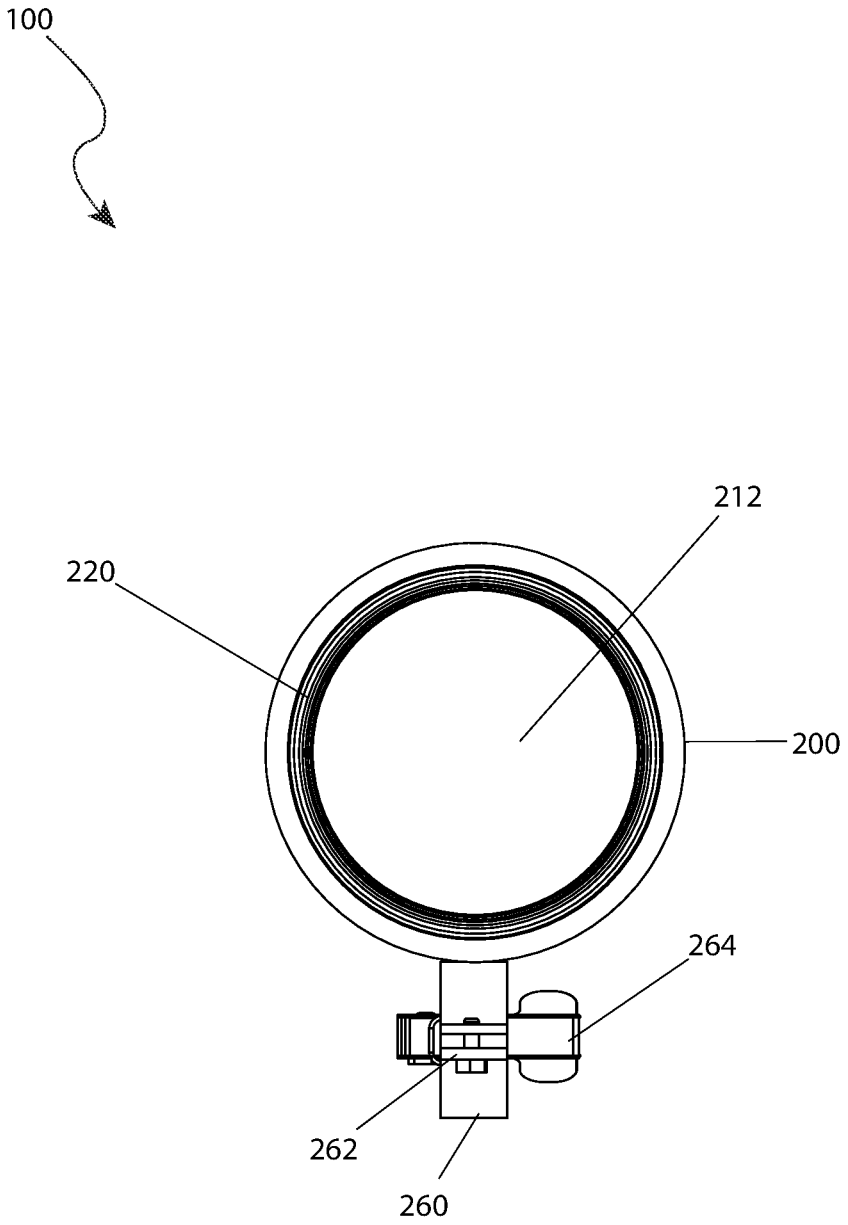
FIG. 6 is a top view of an adjustable portable cup holder, according to an embodiment of the present invention.
Figure 7:
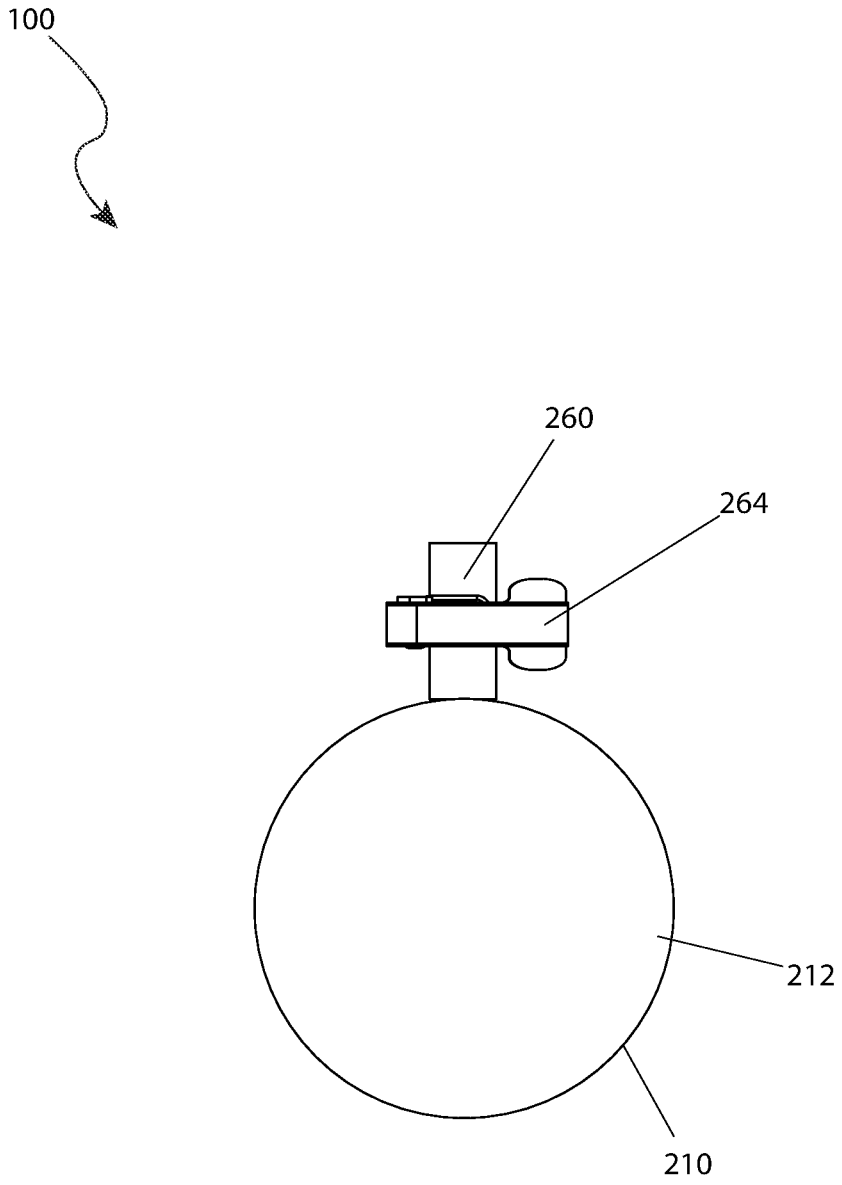
FIG. 7 is a bottom view of an adjustable portable cup holder, according to an embodiment of the present invention.

FIG. 6 is a top view of an adjustable portable cup holder, according to an embodiment of the present invention. The bottom ring 210 may comprise a bottom surface 212. The bottom ring 210 may be an annular collar surrounding the bottom of the invention 100. FIG. 7 is a bottom view of an adjustable portable cup holder, according to an embodiment of the present invention. The beverage container 900 may pass into the bottom ring 210 from the top. The bottom ring 210 may comprise the bottom surface 212 which may prevent the beverage container 900 from passing through the bottom ring 210.

Figure 3:
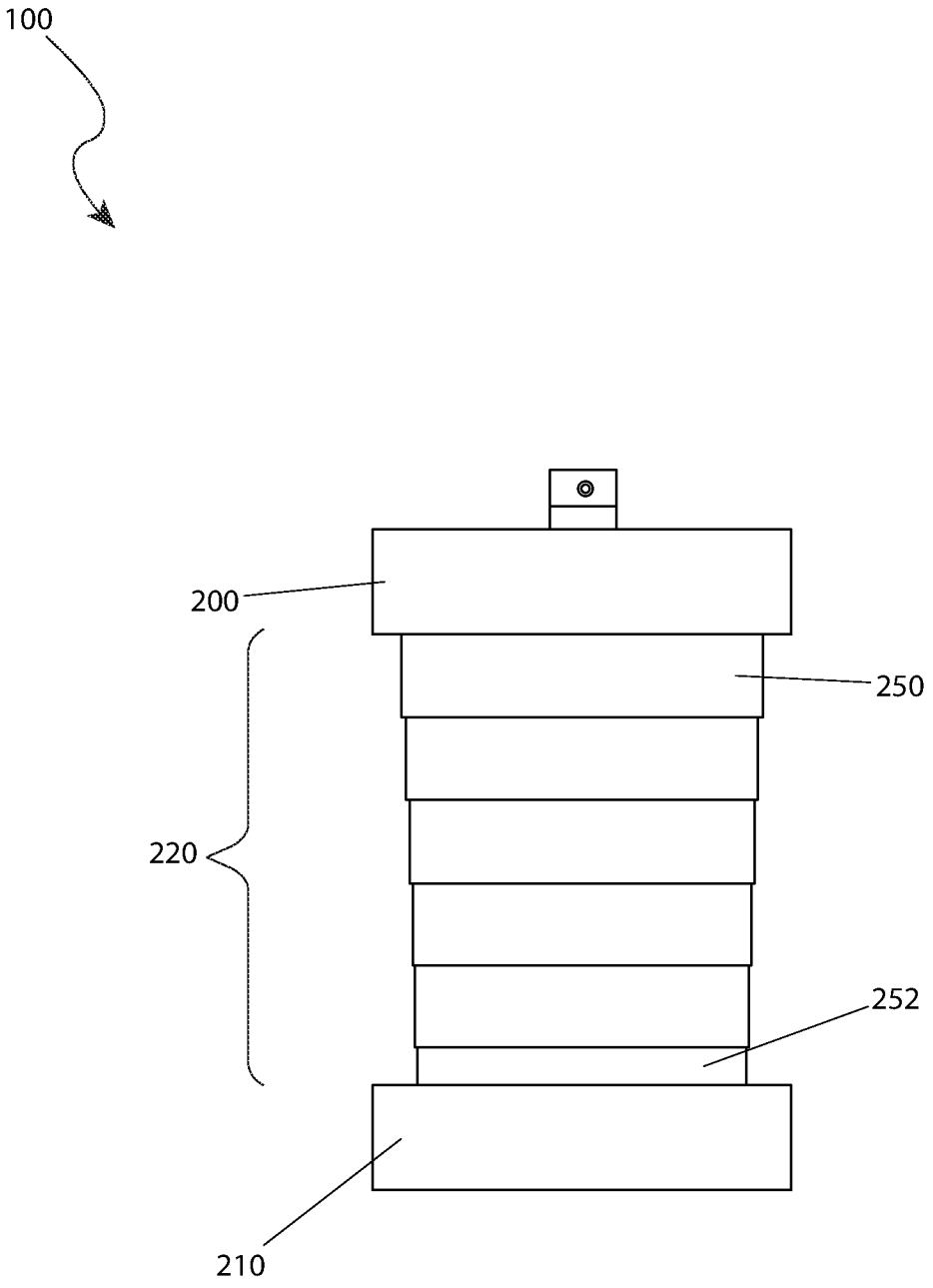
FIG. 3 is a front view of an adjustable portable cup holder, according to an embodiment of the present invention.

FIG. 3 is a front view of an adjustable portable cup holder, according to an embodiment of the present invention. The plurality of intermediate rings 220 may be a plurality of annular bands that may be interposed between the top ring 200 and the bottom ring 210. The plurality of intermediate rings 220 may be of decreasing diameters with a highest intermediate ring 250 being larger than a lowest intermediate ring 252.

An individual intermediate ring 230 selected from the plurality of intermediate rings 220 may be vertically tapered such that a second diameter 272 measured as the outside diameter at the top of the individual intermediate ring 230 may be wider than a third diameter 274 measured as the outside diameter at the bottom of the individual intermediate ring 230. The second diameter 272 may be narrower than a fourth diameter 276 measured as the outside diameter at the top of a ring immediately above 240 and wider than a fifth diameter 278 measured as the outside diameter at the top of a ring immediately below 242. The second diameter 272 of the individual intermediate ring 230 may be wider than a sixth diameter 280 measured as the inside diameter at the bottom of the ring immediately above 240 so that the individual intermediate ring 230 does not fall through the ring immediately above 240. A seventh diameter 282 measured as the inside diameter at the bottom of the individual intermediate ring 230 may be narrower than the fifth diameter 278 of the ring immediately below 242 so that the ring immediately below 242 does not fall through the individual intermediate ring 230.

The plurality of intermediate rings 220 may slidably couple to each other and may collapse to the height of one (1) of the individual intermediate rings 230 when each of the individual intermediate rings 230 slides up into the ring immediately above 240. The individual intermediate ring 230 may expand when each of the individual intermediate rings 230 slides down out of the ring immediately above 240 to the point where the top of the individual intermediate ring 230 cannot pass through the bottom of the ring immediately above 240.

Figure 10:
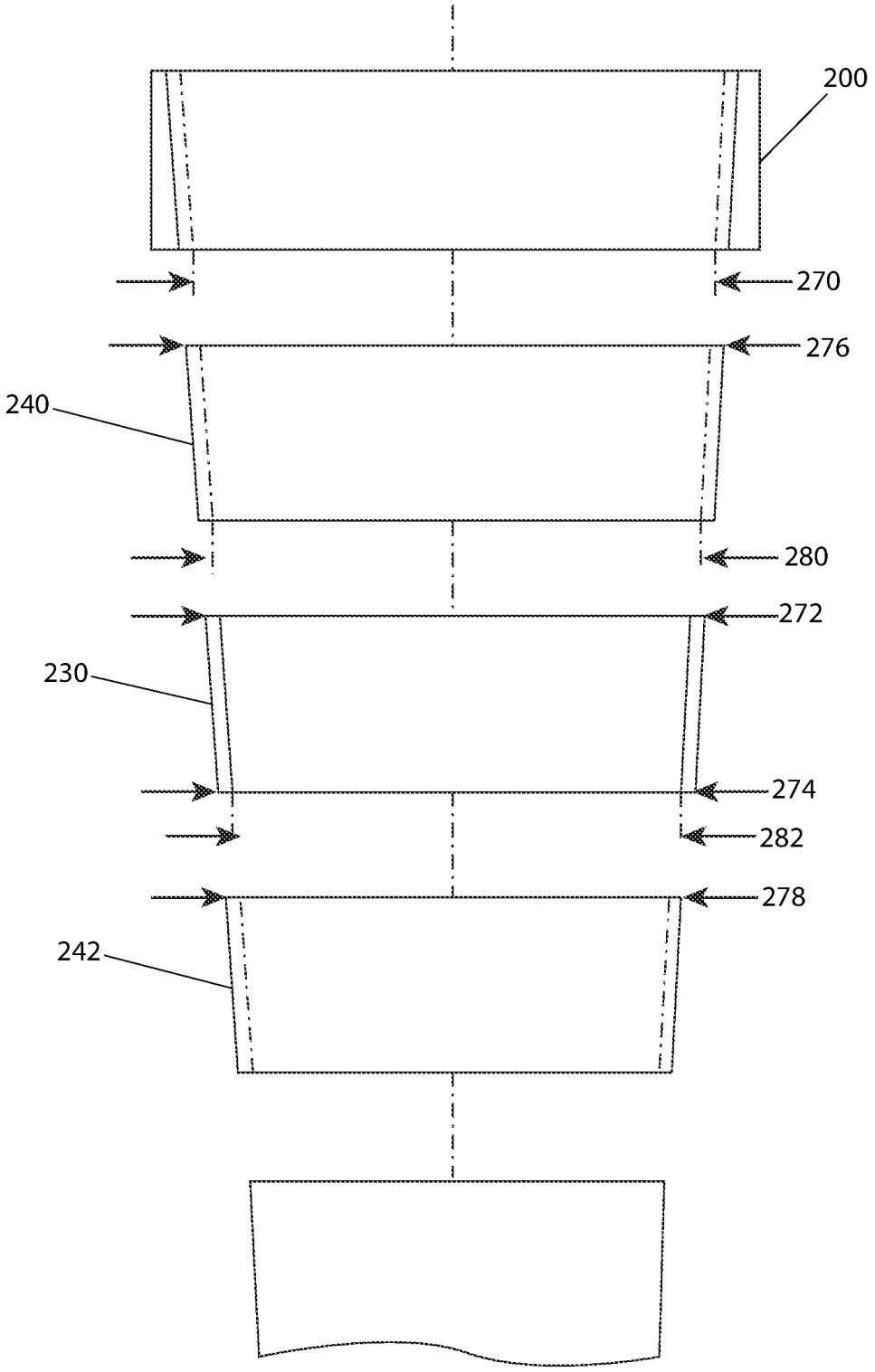
FIG. 10 is an exploded view of an adjustable portable cup holder, according to an embodiment of the present invention illustrating the stack up of the top ring, an individual intermediate ring, the ring immediately above, the ring immediately below, and various diameters of intermediate rings.

FIG. 10 is an exploded view illustrating the relationship between some of the plurality of intermediate rings 220 and their diameters as described above. Note that to stack the plurality of intermediate rings 220 for use, each of the plurality of intermediate rings 220 must be inserted into the ring immediately above 240 from the top of the ring immediately above 240 because the relative diameters prevent the lower rings from passing through the upper rings. (FIG. 10 is not drawn to scale).

The top of the highest intermediate ring 250 may slidably couple to the top ring 200 such that the highest intermediate ring 250 may slide into the top ring 200 when the invention 100 is collapsed and may slide out of the bottom of the top ring 200 when the invention 100 is expanded. The bottom of the lowest intermediate ring 252 may be coupled to the bottom ring 210. The top ring 200 and the bottom ring 210 may extend outward from the intermediate rings 220.

The invention 100 may collapse when opposing forces are applied to the top of the top ring 200 and to the bottom of the bottom ring 210 such that the bottom ring 210 is pushed towards the top ring 200. As the bottom ring 210 is pushed upwards, each of the individual intermediate rings 230 may move up into the ring immediately above 240 or into the top ring 200 until the bottom ring 210 contacts the top ring 200. In some embodiments, the invention 100 may be the height of the top ring 200 plus the height of the bottom ring 210 when collapsed. The invention 100 may expand when opposing forces are applied to the top of the top ring 200 and to the bottom of the bottom ring 210 such that the bottom ring 210 is pulled away from the top ring 200. As the bottom ring 210 is pulled downwards, each of the individual intermediate rings 230 may move out of the ring immediately above 240 or out of the top ring 200 until none of the individual intermediate rings 230 may move further.

Figure 4:
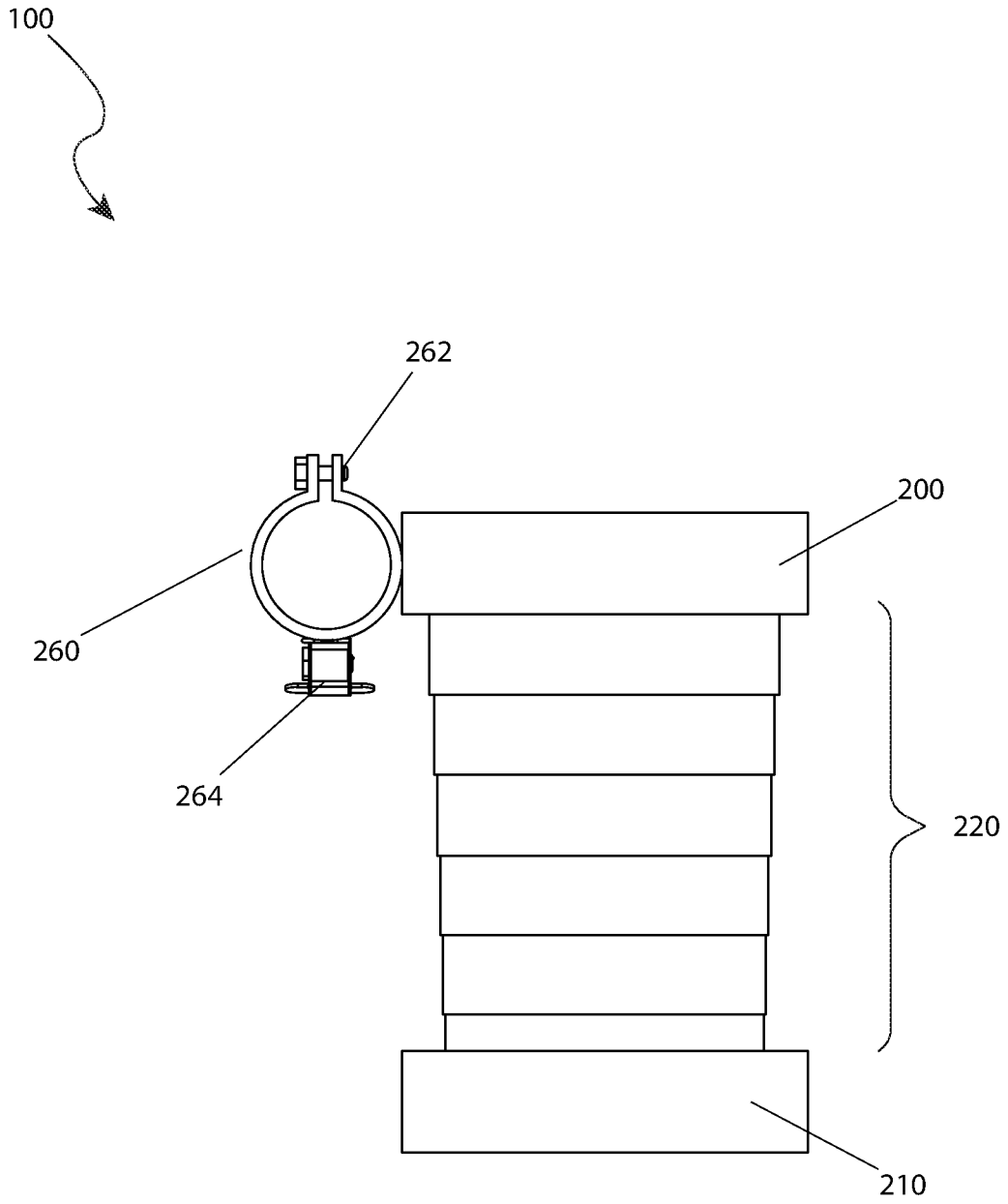
FIG. 4 is a left side view of an adjustable portable cup holder, according to an embodiment of the present invention.
Figure 5:
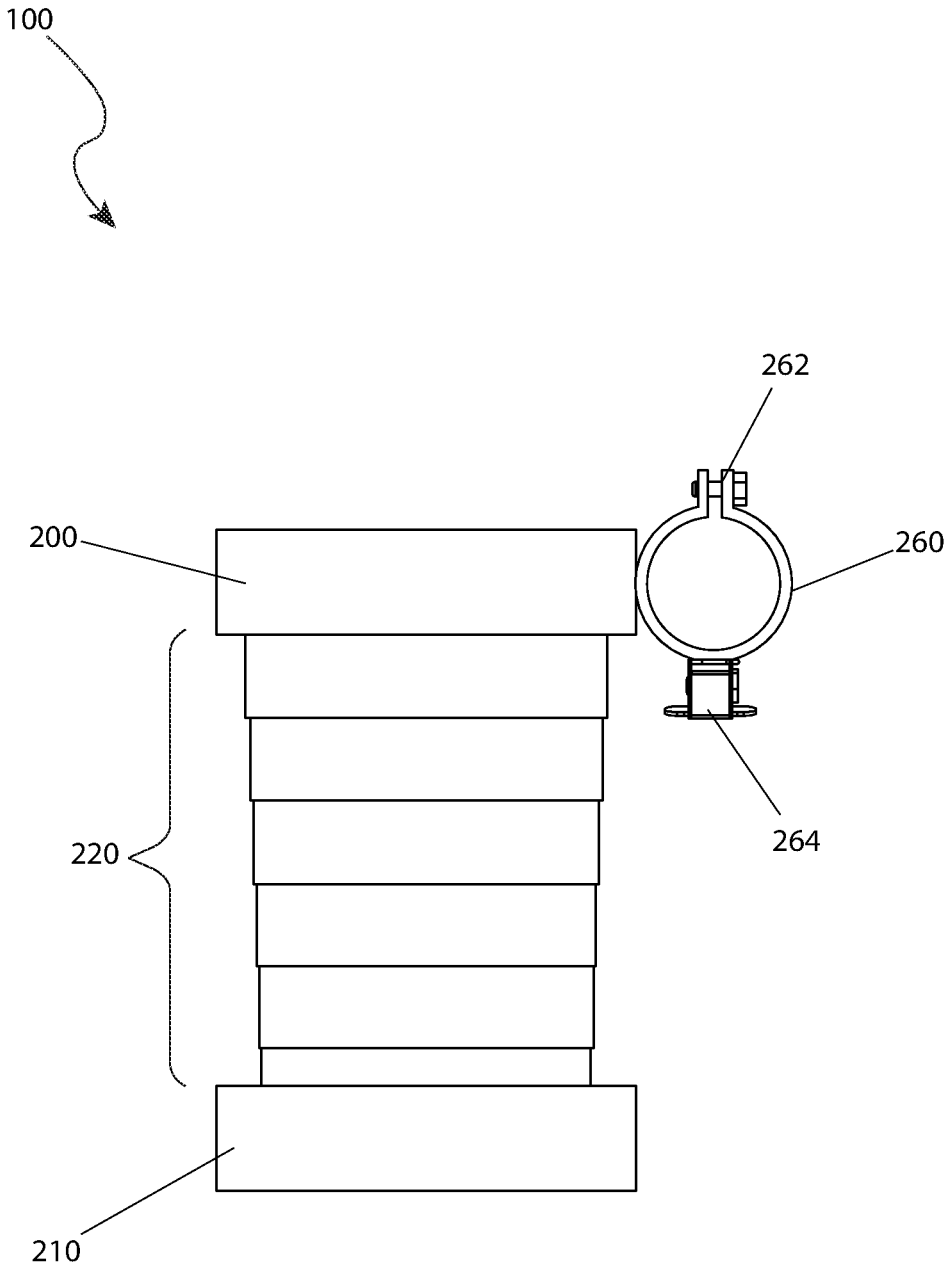
FIG. 5 is a right-side view of an adjustable portable cup holder, according to an embodiment of the present invention.

FIG. 1 is an isometric view of an adjustable portable cup holder, according to an embodiment of the present invention. The attachment band 260 may be coupled to the top ring 200. The attachment band 260 may be operable to detachably couple the invention 100 to the mounting point 910. FIG. 5 is a right-side view of an adjustable portable cup holder, according to an embodiment of the present invention. The attachment band 260 may comprise an adjustment gap 262 which may be operable to adjust the inside diameter of the attachment band 260. The attachment band 260 may further comprise a release clip 264. FIG. 4 is a left side view of an adjustable portable cup holder, according to an embodiment of the present invention. The release clip 264 may be operable to open the attachment band 260 such that the attachment band 260 may pass around an armature of the mounting point 910 when installed or removing the invention 100.

Figure 9B:
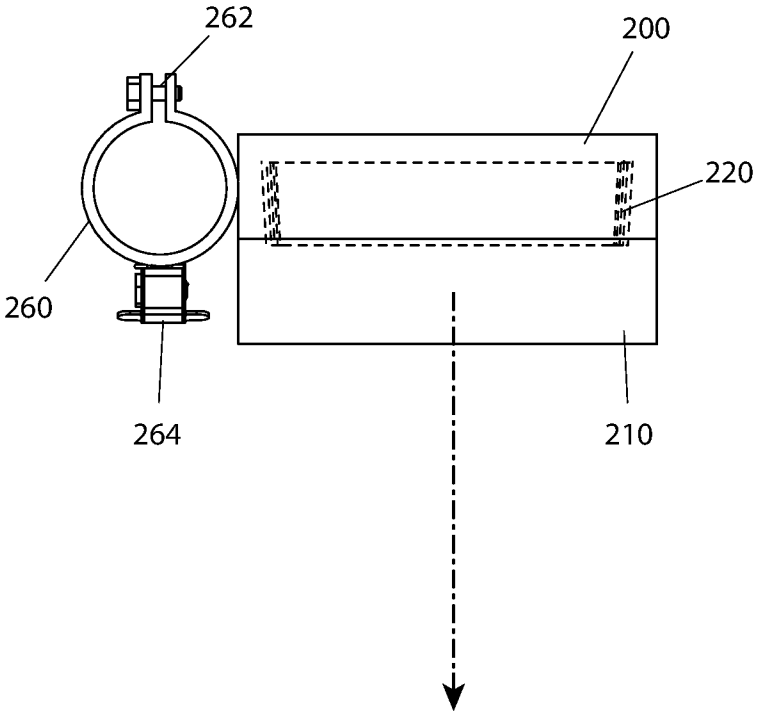
FIG. 9B is a detail view of an adjustable portable cup holder, according to an embodiment of the present invention illustrating a collapsed adjustable portable cup holder and showing an expanding forced applied.
Figure 9A:
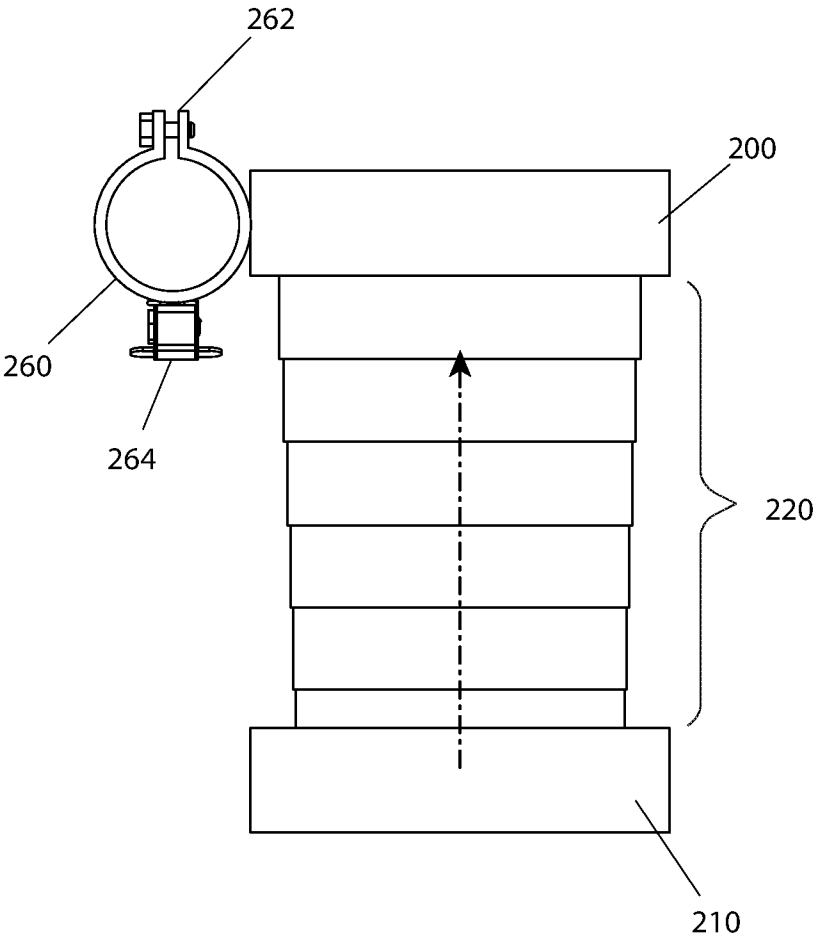
FIG. 9A is a detail view of an adjustable portable cup holder, according to an embodiment of the present invention illustrating an expanded adjustable portable cup holder and showing a collapsing forced applied.

Note that the top ring 200 becomes immovable when the attachment band 260 is coupled to the mounting point 910 and therefore collapsing and expanding the invention 100 may be achieved by pushing and pulling the bottom ring 210 alone. FIG. 9A illustrates the invention 100 when expanded and shows the direction that the force is applied to the bottom ring 210 to collapse the invention 100. FIG. 9B illustrates the invention 100 when collapsed and shows the direction that the force is applied to the bottom ring 210 to expand the invention 100.

Figure 2:
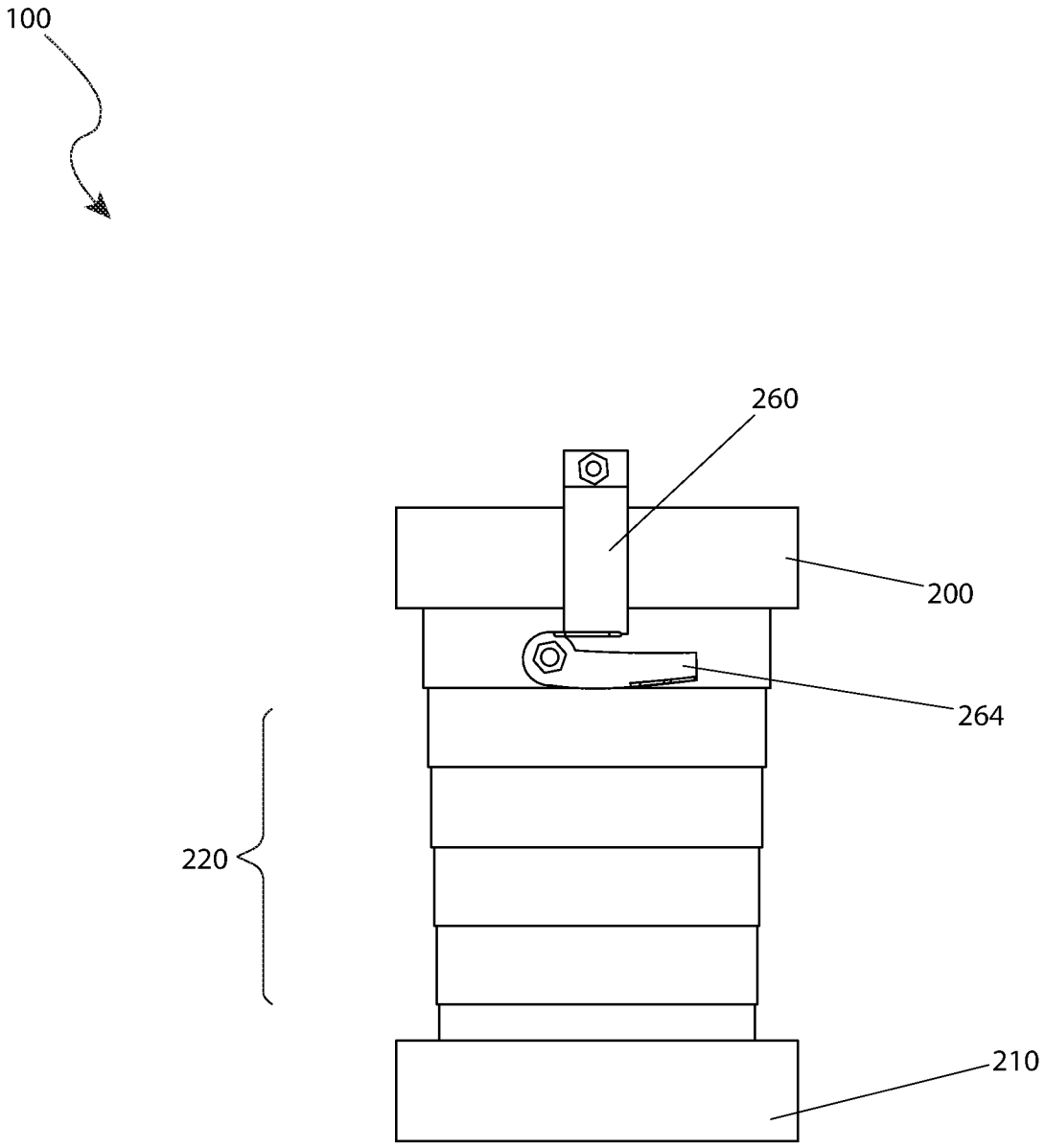
FIG. 2 is a rear view of an adjustable portable cup holder, according to an embodiment of the present invention.

FIG. 2 is a rear view of an adjustable portable cup holder, according to an embodiment of the present invention. In use, the invention 100 may be coupled to the mounting point 910 by operating the release clip 264 to open the attachment band 260, passing the attachment band 260 around an armature of the mounting point 910, and closing the attachment band 260 using the release clip 264. The beverage container 900 may be inserted into the top aperture 202 of the top ring 200 and the weight of the beverage container 900 may push the bottom ring 210 down. As the bottom ring 210 moves down, the bottom ring 210 may pull the plurality of intermediate rings 220 causing the invention 100 to expand until the invention 100 supports the beverage container 900. The beverage container 900 may be removed from the invention 100 and reinserted as desired by a user. When no longer needed, the beverage container 900 may be removed from the invention 100, the bottom ring 210 may be pushed towards the top ring 200 to collapse the invention 100, and the attachment band 260 may be decoupled from the mounting point 910 by reversing the steps to couple the attachment band 260.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An adjustable portable cup holder, comprising:

a top ring having a top, a bottom, and a top aperture, the top aperture is vertically oriented within the top ring and the top aperture includes a top and a bottom;

a bottom ring having a bottom surface;

a plurality of intermediate rings having a plurality of annular bands that are interposed between the top ring and the bottom ring; and an attachment band adjusted to fit a mounting point of a beverage container, the attachment band is coupled to the top ring and the attachment band includes an adjustment gap which is operable to adjust an inside diameter of the attachment band;

wherein the intermediate rings have a plurality of decreasing diameters with a highest intermediate ring being larger than a lowest intermediate ring;

wherein the intermediate rings are vertically tapered;

wherein the intermediate rings slidably couple to each other and collapse to a height of one of the individual intermediate rings when each of the individual intermediate rings slide up into the ring immediately above it;

wherein the bottom ring pulls the intermediate rings causing the adjustable portable cup holder to expand until the adjustable portable cup holder supports the beverage container wherein the top aperture includes a plurality of sloped internal walls;

wherein the top of the top aperture is wider than the bottom of the top aperture;

wherein the bottom of the top aperture is at least as large as an outside diameter of the beverage container such that the beverage container passes through the top ring when inserted into the top ring from the top of the top ring;

wherein the top ring becomes immovable when the attachment band is coupled to the mounting point;

wherein collapsing and expanding the adjustable portable cup holder is achieved by pushing and pulling the bottom ring;

wherein the bottom ring includes the bottom surface which prevents the beverage container from passing through the bottom ring;

wherein the attachment band includes a release clip;

wherein the adjustable portable cup holder is coupled to the mounting point by operating the release clip to open the attachment band, passing the attachment band around an armature of the mounting point;

wherein the release clip closes the attachment band;

wherein the beverage container is inserted into the top aperture of the top ring and the beverage container's weight pushes the bottom ring down; and, wherein the beverage container is removed from the adjustable portable cup holder when the bottom ring is pushed towards the top ring to collapse the adjustable portable cup holder and the attachment band is decoupled from the mounting point.

2. The adjustable portable cup holder, according to claim 1, wherein the mounting point is selected from the group consisting of a beach chair, a stroller, or a grocery cart.

3. The adjustable portable cup holder, according to claim 1, wherein the beverage container is selected from the group consisting of a beverage cup, a water bottle, or a beverage can.

4. The adjustable portable cup holder, according to claim 1, wherein the adjustable portable cup holder is coupled to the mounting point and is operable to hold the beverage container.

5. The adjustable portable cup holder, according to claim 1, wherein the adjustable portable cup holder collapses for ease of storage and expands when ready for use.

* * * * *